United States Patent [19]

Lawrence

[11] 4,092,507

[45] May 30, 1978

[54] ELECTRIC CURRENT SUPPLY INSTALLATION

[75] Inventor: Tony Lawrence, Newhaven, England

[73] Assignee: Rotaflex (Great Britian) Limited, London, United Kingdom

[21] Appl. No.: 759,859

[22] Filed: Jan. 17, 1977

[30] Foreign Application Priority Data

Jan. 19, 1976 United Kingdom ..... 1996/76

[51] Int. Cl.[2] ..... H01R 13/70; H01R 9/00; H01R 13/54

[52] U.S. Cl. ..... 200/51 R; 339/21 R; 339/91 R

[58] Field of Search ..... 200/51 R, 51.07, 51.08; 339/21 R, 22 T, 22 B, 88 R, 91 R

[56] References Cited

U.S. PATENT DOCUMENTS 3,832,673 8/1974 Le Hir ..... 200/51 R X
3,980,368 9/1976 Fremont ..... 329/21 R
4,032,208 6/1977 Berkenhoff ..... 200/51.08 X

*Primary Examiner*—William Price
*Assistant Examiner*—Steven M. Pollard
*Attorney, Agent, or Firm*—Arthur B. Colvin

[57] ABSTRACT

An adaptor or connector for use with a continuous outlet current supply installation including a channel-section track member housing elongate conductors, comprises a body portion carrying fixed contact fingers and securing lugs, the whole adaptor being rotatable through 90° to engage the securing lugs with the track and the contact fingers with the conductors, and the adaptor being provided with a switch connected in series with one of the contact fingers and having an operating member in common with a projection which serves to lock the adaptor in proper rotational alignment with the track member, the arrangement being such that the switch cannot be closed when the locking projection is retracted and the locking projection cannot be retracted while the switch is closed.

8 Claims, 3 Drawing Figures

ELECTRIC CURRENT SUPPLY INSTALLATION

This invention relates to adaptors for use with electric current supply installations of the continuous outlet type comprising a channel-section track member which houses at least two spaced apart elongate conductors extending longitudinally within the track channel.

Adaptors (sometimes known as connectors) for use with such installations are known which comprise an insulated body carrying fixed contact fingers and fixed mechanical securing means, such as oppositely directed lugs, a portion of the adaptor being inserted into the track channel and the whole adaptor being rotated through 90° to bring the securing means into mechanical engagement with the track channel and the contact fingers into electrical contact with the track conductors. Adaptors of this general form are referred to herein as "of the kind set forth".

In use of an adaptor of the above kind, the contact fingers are connected by flex to the appliance to be powered, which is preferably secured to the adaptor body and thereby supported on the track.

Some known adaptors of the kind set forth have no switching facility of any form, and others incorporate electric switches in series with one of the contact fingers and the appliance flex. In accordance with the present invention there is provided an adaptor of the kind set forth comprising a manually operable switch electrically connected in series with one of the contact fingers, and interlock means to permit closure of the switch only when the adaptor is in predetermined, correct rotational alignment with respect to a track channel with which the adaptor is engaged. This construction ensures that, in use, electric contact between the contact fingers and an appliance to be powered can only be made and broken while the adaptor is securely engaged with the track, thereby making the adaptor safer to use.

In a preferred form the adaptor includes locking means for releasably locking the adaptor in correct rotational alignment with the track, and the locking means interlocks with the switch operating member. More specifically the operating member of the electric switch is integral or otherwise fast with a retractable projection which constitutes the locking means and is engageable with the track channel to prevent release of the adaptor from the track channel. Movement of the operating member and projection to the retracted position is preceded by opening of the switch. The switch operating member may consist of a simple slide carrying a movable switch contact and formed with a nose portion which constitutes the said projection.

A presently preferred adaptor embodying the invention will now be described, by way of example, with reference to the accompanying drawings, in which.

Figure 1:
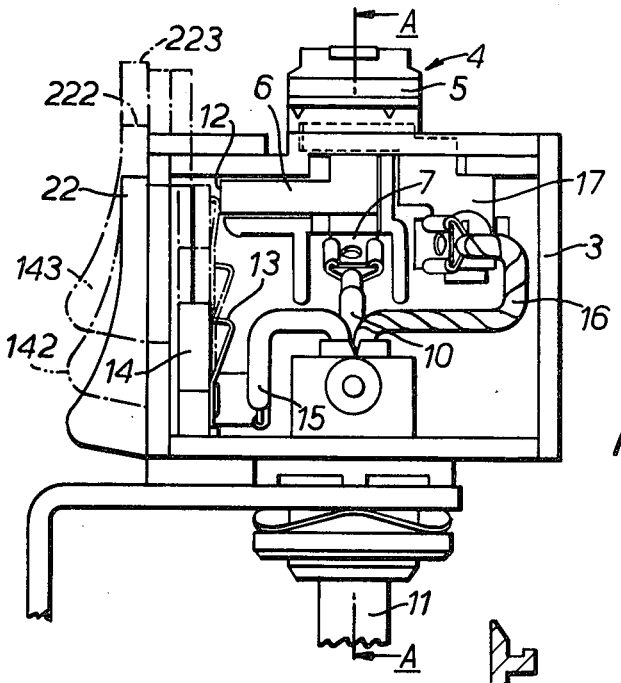
FIG. 1 is a side view of the adaptor with its side cover plate removed.
Figure 3:
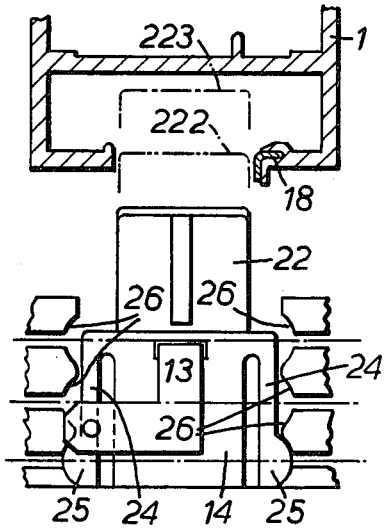
FIG. 3 is an interior view of the switch mechanism of the adaptor.
Figure 2:
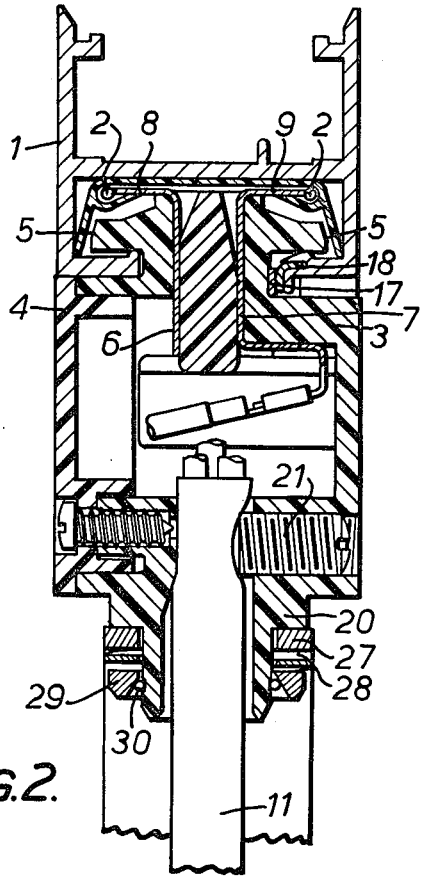
FIG. 2 is a section on the line A—A of FIG. 1.

The adaptor shown in the drawings is of the kind set forth and is engaged with and disengaged from a track channel 1 having insulated conductors 2 by rotation of the whole adaptor through 90° of arc. The adaptor comprises a hollow insulated body 3 having a removable side-cover plate 4 and a projecting nose portion comprising a pair of fixed, radially projecting opposed lugs 5 for mechanical engagement with the track channel 1. A pair of contact blades 6, 7 terminate at their outer ends in fixed, radially projecting contact fingers 8, 9 overlying and spaced from the lugs 5 for contact with the respective track conductors. The "neutral" blade 7 is connected at its inner end to the corresponding conductor 10 of an appliance flex 11, and the "live" blade 6 terminates at its inner end in a fixed switch contact portion 12, cooperating with a moving switch contact 13 carried by a slide 14 and connected to the live conductor 15 of the flex 11. The earthing conductor 16 of the flex is connected to an earth contact strip 17 which engages a copper earth continuity strip 18 of the track when the adaptor is engaged in the track channel. The appliance flex 11 is taken out through a hollow boss 20 and clamped by a cord screw 21.

The slide 14 carrying the moving switch contact 13 is mounted for sliding movement on an end of the housing and is shown in full line in its inoperative or retracted position in which a projecting nose portion 22 of the slide is below the mouth of the track channel, and the moving contact 13 is clear of the fixed switch contact portion 12. With the slide in this position the adaptor can be rotated into or out of engagement with the track channel.

In a second, intermediate position of the slide, indicated at 142, the nose portion projects, at 222 into the mouth of the track channel, to lock the adaptor against rotation relative to the track channel, but the moving contact 13 is still clear of fixed contact portion 12, so that the adaptor (and the appliance which it supports) are mechanically locked to the track but still isolated from the power supply.

To connect the appliance electrically, the slide 14 is moved into its third position, indicated at 143, 223, in which the contact 13 is brought into engagement with contact portion 12.

Thus the interlock between the mechanical locking projection 22 and the switch operating slide 14, provided in the illustrated embodiment by forming the projection integral with the slide, ensures that the appliance mounted on the adaptor cannot be connected electrically to the track channel conductors unless the adaptor is in proper engagement with the track channel and the adaptor cannot be disengaged from the track without first opening the switch. It will be appreciated by those skilled in the art that other forms of interlock could be employed.

Indexing of the slide between three positions is facilitated by the provision on the slide of flexible arms 24 having bulbous protrusions 25 which make resilient snap fitting engagement in corresponding pairs of recesses 26 formed adjacent the path of the slide in the housing walls. This detent arrangement provides not only for a clear indication of the slide moving into one of its three positions, but also provides a degree of snap-action to reduce the risk of arcing between the fixed and moving contacts of the switch.

As shown, the adaptor boss 20 also provides a convenient attachment for an appliance support, such as a spotlight bracket 27 retained by a corrugated spring washer 28, collar 29 and circlip 30, which retain the bracket firmly but permit its rotation about the boss.

I claim:

1. In an adaptor for use with an electric current supply installation including a channel-section track member housing at least two longitudinal conductors, the adaptor having an insulated body, a portion for insertion in said track channel, fixed contact fingers and fixed mechanism securing means carried on said adaptor portion, the adaptor being rotatable through 90° to engage mechanically said securing means and said track member and to bring said contact fingers into contact with said conductors, and an electrical switch having switch contacts movable into and out of contact with each other to open and close said switch, one of said switch contacts being electrically connected to one of said contact fingers, and said switch having an operating member, the improvement which comprises means interlocking with said switch operating member to permit operation of said member to close said switch only when the adaptor is in a predetermined rotational position with respect to a track member in which said adaptor portion is inserted.

2. An adaptor according to claim 1, wherein the adaptor is provided with releasable locking means engageable with said track member to lock the adaptor in said predetermined rotational alignment relative to said track member, said locking means interlocking with said switch operating member in such a manner that said switch can only be closed when said locking means is engaged.

3. An adaptor according to claim 2, wherein said locking means and said switch operating member are so interlocked that said locking means cannot be released while said switch is closed.

4. An adaptor according to claim 3, wherein said locking means comprises a projection integral or otherwise fast with said switch operating member.

5. An adaptor according to claim 4, wherein the switch operating member is slidable relative to said adaptor body to operate both said switch and said locking means.

6. An adaptor according to claim 5, wherein said switch operating member carries a first one of said switch contacts for movement therewith into and out of engagement with a second of said switch contacts, said second switch contact being fixed and integrally formed with said one contact finger.

7. An adaptor according to claim 5, wherein detent means are provided on said slidable operating member and said adaptor body, said detent means defining three positions for said slidable member, namely a first position in which said switch is open and said projection retracted, a second position in which said switch is open and said projection is extended into a locking position, and a third position in which said switch is closed and said projection is fully extended.

8. An adaptor according to claim 7, wherein said detent means comprise a resilient arm on said switch operating member and recess means on said adaptor body.

* * * * *